US012446693B2

(12) United States Patent
Li et al.

(10) Patent No.: US 12,446,693 B2
(45) Date of Patent: Oct. 21, 2025

(54) ELDERLY CHAIR SUPPORT AND ELDERLY CHAIR

(71) Applicant: DEWERTOKIN TECHNOLOGY GROUP CO., LTD., Jiaxing (CN)

(72) Inventors: Long Li, Jiaxing (CN); Qiqi Ye, Jiaxing (CN); Liming Yang, Jiaxing (CN); Weiyao Zhou, Jiaxing (CN); Bin Shen, Jiaxing (CN); Kangming Tao, Jiaxing (CN); Guowei Wang, Jiaxing (CN)

(73) Assignee: DEWERTOKIN TECHNOLOGY GROUP CO., LTD., Jiaxing (CN)

( * ) Notice: Subject to any disclaimer, the term of this patent is extended or adjusted under 35 U.S.C. 154(b) by 198 days.

(21) Appl. No.: 18/281,361

(22) PCT Filed: Feb. 24, 2022

(86) PCT No.: PCT/CN2022/077555
§ 371 (c)(1),
(2) Date: Sep. 11, 2023

(87) PCT Pub. No.: WO2022/188631
PCT Pub. Date: Sep. 15, 2022

(65) Prior Publication Data

US 2024/0148144 A1 May 9, 2024

(30) Foreign Application Priority Data

Mar. 11, 2021 (CN) ..... 202120515358.3

(51) Int. Cl.
*A47C 1/034* (2006.01)
*A47C 1/024* (2006.01)

(52) U.S. Cl.
CPC ..... *A47C 1/0345* (2013.01); *A47C 1/0242* (2013.01)

(58) Field of Classification Search
CPC ... A47C 7/5062; A47C 7/5066; A47C 1/0242; A47C 1/0345
(Continued)

(56) References Cited

U.S. PATENT DOCUMENTS 4,007,960 A * 2/1977 Gaffney ..... A61G 5/14 297/DIG. 10
10,376,060 B2 * 8/2019 Marcantoni ..... A47C 1/0342
2020/0221874 A1 7/2020 Carrera

FOREIGN PATENT DOCUMENTS

CN 104287492 A 1/2015
CN 204950131 U 1/2016
(Continued)

OTHER PUBLICATIONS

International Search Report for corresponding application PCT/CN2022/077555 filed on Feb. 24, 2022; Mail date Apr. 28, 2022.

*Primary Examiner* — Milton Nelson, Jr.
(74) *Attorney, Agent, or Firm* — CANTOR COLBURN LLP

(57) ABSTRACT

Provided are an elderly chair support and an elderly chair. A support assembly of the elderly chair support includes a support plate (41) and an anti-torsion tube (42) fixedly connected to the support plate (41); two ends of a first lifting rod (6) are pivoted to the support plate (41) and a base (1) respectively, and two ends of a second lifting rod (7) are pivoted to the support plate (41) and the base (1) respectively; and a first drive assembly is capable of driving a power rod (3) to rotate relative to the support plate (41) to have a first position and a second position, in the case where the power rod (3) is at the first position, a leg assembly (5) stretches and the anti-torsion tube (42) abuts against the base (1), in the case where the power rod (3) is at the second position, the leg assembly (5) retracts and the anti-torsion tube (42) has a first distance from the base (1), and in the
(Continued)

case where the power rod (3) is at the second position, the first drive assembly is capable of driving the power rod (3) to drive the support plate (41) to move synchronously so that the support plate (41) has a second distance from the base (1). The elderly chair support and the elderly chair have high stability and are simple in structure.

16 Claims, 4 Drawing Sheets

(58) Field of Classification Search
USPC ..... 297/85 M
See application file for complete search history.

(56) References Cited

FOREIGN PATENT DOCUMENTS

| | | | | |
|---|---|---|---|---|
| CN | 206166333 | U | | 5/2017 |
| CN | 209031604 | U | * | 6/2019 |
| CN | 209436695 | U | | 9/2019 |
| CN | 211048882 | U | | 7/2020 |
| CN | 112244552 | A | | 1/2021 |
| CN | 212437951 | U | | 2/2021 |

* cited by examiner

ELDERLY CHAIR SUPPORT AND ELDERLY CHAIR

CROSS-REFERENCE TO RELATED APPLICATION

This is a National stage application, filed under 37 U.S.C. 371, of International Patent Application NO. PCT/CN2022/077555, filed on Feb. 24, 2022, which is based on and claims priority to Chinese Patent Application No. 202120515358.3 filed with the China National Intellectual Property Administration (CNIPA) on Mar. 11, 2021, the disclosure of which is incorporated herein by reference in its entirety.

TECHNICAL FIELD

The present disclosure relates to the technical field of mechanical devices, for example, an elderly chair support and an elderly chair.

BACKGROUND

With the continuous improvement of living standards, attention is gradually paid to the health of the elderly, and the design of products suitable for the elderly will become the service focus of the aging society. As the age gradually increases, the elderly gradually suffer from osteoporosis. As a result, the majority of the elderly have poor legs, feel tired when standing for a long time, and sit and lie for a much longer time than standing. Therefore, the elderly chairs in increasingly great demand, and there is great room for development in the domestic market. The elderly chairs are mechanical devices designed according to the body conditions of the elderly and have the functions of helping the elderly to adjust their sitting postures and assisting in their standing. However, the elderly chairs have poor stability and are complex in structure in the related art.

SUMMARY

The present disclosure provides an elderly chair support and an elderly chair, so as to solve the problems of poor stability and a complex structure of an elderly chair in the related art.

In a first aspect, the present disclosure provides an elderly chair support. The elderly chair support includes a base, a first drive assembly, a power rod, a support assembly, a leg assembly, a first lifting rod, and a second lifting rod.

The support assembly includes a support plate and an anti-torsion tube fixedly connected to the support plate; two ends of the first lifting rod are pivoted to the support plate and the base respectively, and two ends of the second lifting rod are pivoted to the support plate and the base respectively.

The first drive assembly is capable of driving the power rod to rotate relative to the support plate to have a first position and a second position, in the case where the power rod is at the first position, the leg assembly stretches and the anti-torsion tube abuts against the base, in the case where the power rod is at the second position, the leg assembly retracts and the anti-torsion tube has a first distance from the base, and in the case where the power rod is at the second position, the first drive assembly is capable of driving the power rod to drive the support plate to move synchronously so that the support plate has a second distance from the base.

In a second aspect, the present disclosure further provides an elderly chair. The elderly chair includes the preceding elderly chair support.

REFERENCE LIST

Figure 1:
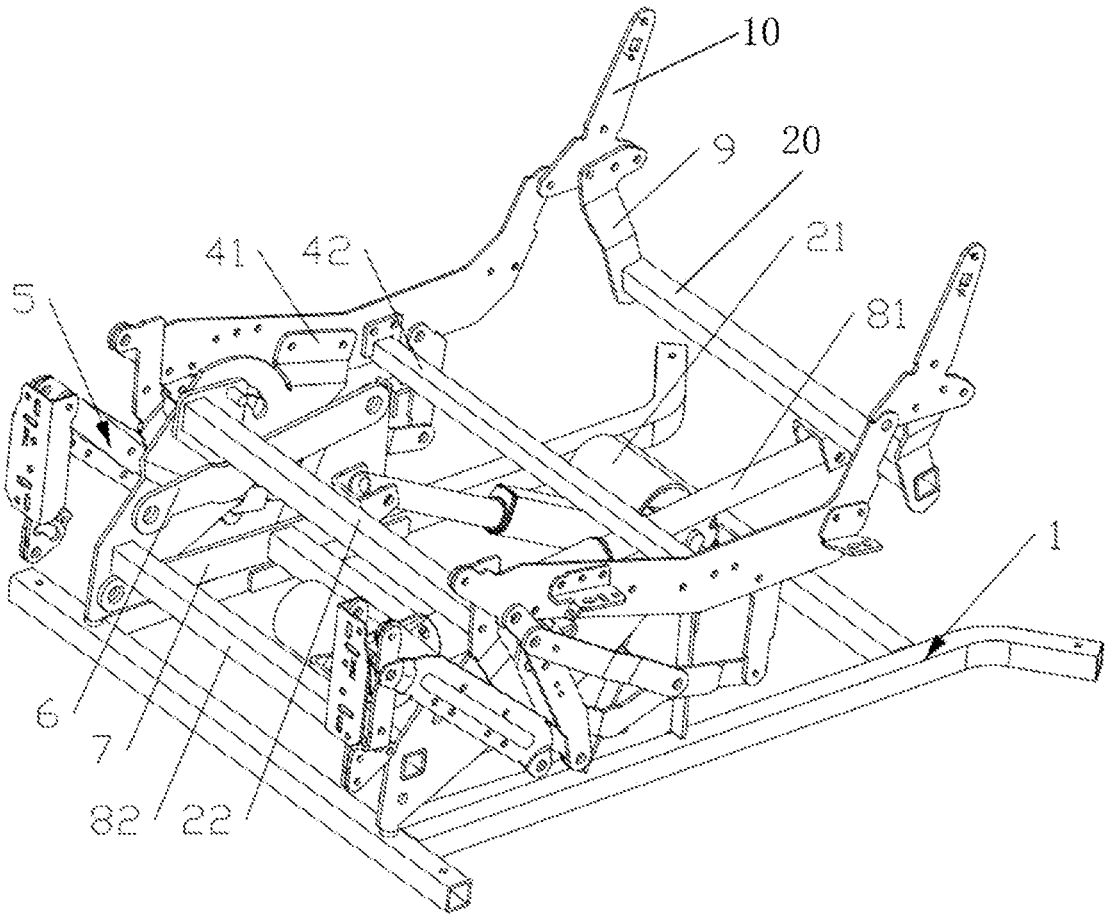
FIG. 1 is a structure view of an elderly chair support according to an embodiment of the present disclosure.

1 base
11 first support rod
12 second support rod
13 third support rod
14 fourth support rod
15 support seat
16 bracket
21 first electric push rod
22 first connecting rod
3 power rod
31 guide post
32 connecting post
41 support plate
42 anti-torsion tube
5 leg assembly
51 first stretching member
52 second stretching member
53 third stretching member
54 fourth stretching member
55 fifth stretching member
56 sixth stretching member
57 seventh stretching member
58 support member
561 guide block
6 first lifting rod
7 second lifting rod
81 second electric push rod
82 second connecting rod
9 angle adjustment member
10 backrest connecting rod
20 third connecting rod

DETAILED DESCRIPTION

The present disclosure is described in detail below in conjunction with the drawings and embodiments.

In the description of the present disclosure, terms "joined", "connected", and "fixed" are to be understood in a broad sense unless otherwise expressly specified and limited. For example, the term "connected" may refer to "fixedly connected", "detachably connected", or "integrated", may refer to "mechanically connected" or "electrically connected", or may refer to "connected directly", "connected indirectly through an intermediary", or "connected inside two components" or an interaction relation between two components. For those of ordinary skill in the art, specific meanings of the preceding terms in the present disclosure may be understood based on specific situations.

In the present disclosure, unless otherwise expressly specified and limited, when a first feature is described as "on" or "under" a second feature, the first feature and the second feature may be in direct contact or may be in contact via another feature between the two features instead of being in direct contact. Moreover, when the first feature is described as "on", "above", or "over" the second feature, the first feature is right on, above, or over the second feature, the first feature is obliquely on, above, or over the second feature, or the first feature is simply at a higher level than the second feature. When the first feature is described as "under", "below", or "underneath" the second feature, the first feature is right under, below, or underneath the second feature, the first feature is obliquely under, below, or underneath the second feature, or the first feature is simply at a lower level than the second feature.

In the description of embodiments, orientations or position relations indicated by terms such as "upper", "lower", and "right" are based on the drawings. These orientations or position relations are intended only to facilitate description and simplify operation and not to indicate or imply that a device or element referred to must have such particular orientations or must be configured or operated in such particular orientations. Thus, these orientations or position relations are not to be construed as limiting the present disclosure. Moreover, terms such as "first" and "second" are used only for distinguishing description and have no special meanings.

The present disclosure provides an elderly chair support and an elderly chair, where the elderly chair support has high stability and is simple in structure.

Figure 4:
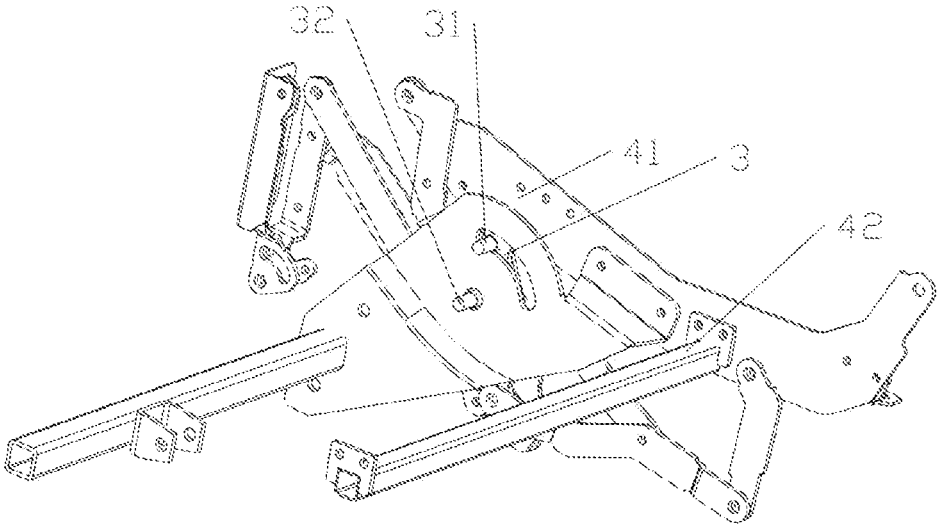
FIG. 4 is a structure view of a leg assembly and a support assembly of an elderly chair support along a second direction according to an embodiment of the present disclosure.
Figure 6:
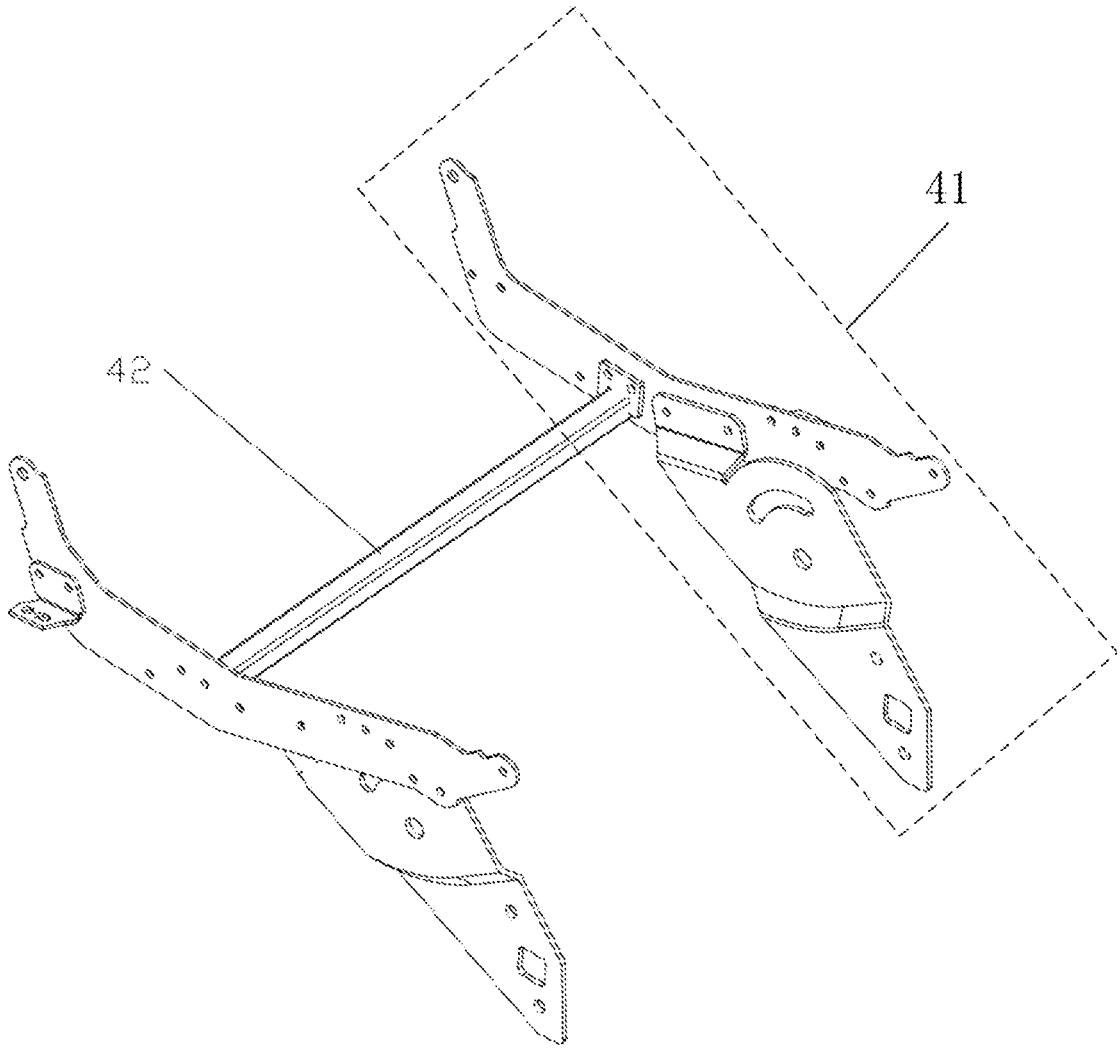
FIG. 6 is a structure view of a support assembly of an elderly chair support according to an embodiment of the present disclosure.

As shown in FIGS. 1, 4, and 6, the elderly chair support includes a base 1, a first drive assembly, a power rod 3, a support assembly, a leg assembly 5, a first lifting rod 6, and a second lifting rod 7, where the support assembly includes a support plate 41 and an anti-torsion tube 42 fixedly connected to the support plate 41; two ends of the first lifting rod 6 are pivoted to the support plate 41 and the base 1 respectively, and two ends of the second lifting rod 7 are pivoted to the support plate 41 and the base 1 respectively; the first drive assembly is capable of driving the power rod 3 to rotate relative to the support plate 41 to have a first position and a second position; when the power rod 3 is at the first position, the leg assembly 5 stretches and the anti-torsion tube 42 abuts against the base 1; when the power rod 3 is at the second position, the leg assembly 5 retracts and the anti-torsion tube 42 has a first distance from the base 1; and when the power rod 3 is at the second position, the first drive assembly is capable of driving the power rod 3 to drive the support plate 41 to move synchronously so that the support plate 41 has a second distance from the base 1.

The first drive assembly drives the power rod 3 to rotate relative to the support plate 41 to have the first position and the second position. When the power rod 3 is at the first position, the leg assembly 5 stretches and the anti-torsion tube 42 abuts against the base 1, when the power rod 3 is at the second position, the leg assembly 5 retracts and the anti-torsion tube 42 has the first distance from the base 1, and when the power rod 3 is at the second position, the first drive assembly continues driving the power rod 3 in a direction away from the first position and can drive the power rod 3 to drive the support plate 41 to move synchronously so that the support plate 41 has the second distance from the base 1. Driven by the first drive assembly, the power rod 3 can drive the leg assembly 5 to move to have a retracted state and a stretched state. Moreover, since the first lifting rod 6, the second lifting rod 7, the support plate 41, and the base 1 constitute a four-bar linkage mechanism, the support plate 41 can be driven by the power rod 3 to move relative to the base 1 so as to be lifted to the second distance so that the elderly chair support has a seated state and a lifted state. The support assembly includes the support plate 41 and the anti-torsion tube 42 fixedly connected to the support plate 41, and the anti-torsion tube 42 can abut against the base 1 when the leg assembly 5 stretches so that the stability of the elderly chair support can be improved. The elderly chair support has high stability and is simple in structure.

As shown in FIG. 1, optionally, the first drive assembly includes a first electric push rod 21 and a first connecting rod 22, where the first electric push rod 21 has an end hinged to the base 1 and the other end hinged to the first connecting rod 22, and the first connecting rod 22 is connected to the power rod 3. The first electric push rod 21 drives, through the first connecting rod 22, the power rod 3 to rotate relative to the support plate 41.

As shown in FIG. 4, optionally, the support plate 41 is provided with a guide slot, and the power rod 3 is provided with a guide post 31, where the guide post 31 is slidably disposed in the guide slot and is connected to the first connecting rod 22. The first electric push rod 21 drives the first connecting rod 22 to drive the power rod 3 to move so that the guide post 31 on the power rod 3 slides in the guide slot on the support plate 41 to allow the power rod 3 to rotate relative to the support plate 41. The power rod 3 is further provided with a connecting post 32, where the connecting post 32 is configured to rotate in a connecting hole on the support plate 41 to assist rotation of the power rod 3 relative to the support plate 41.

Figure 3:
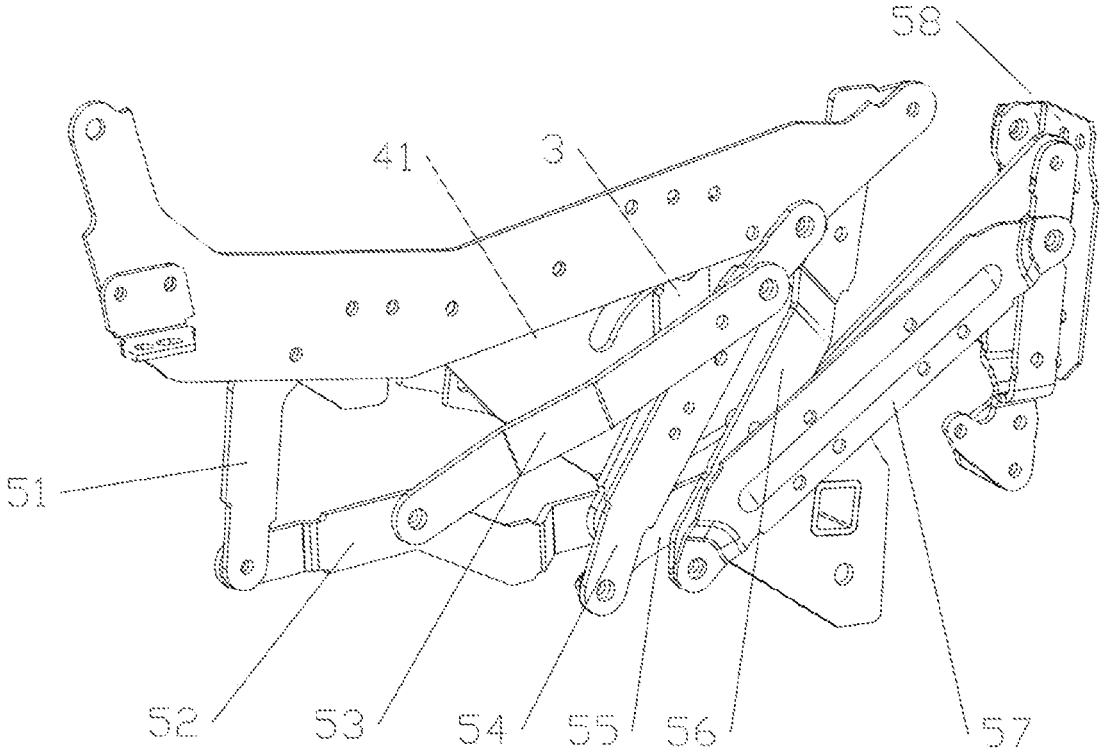
FIG. 3 is a structure view of a leg assembly and a support assembly of an elderly chair support along a first direction according to an embodiment of the present disclosure.
Figure 5:
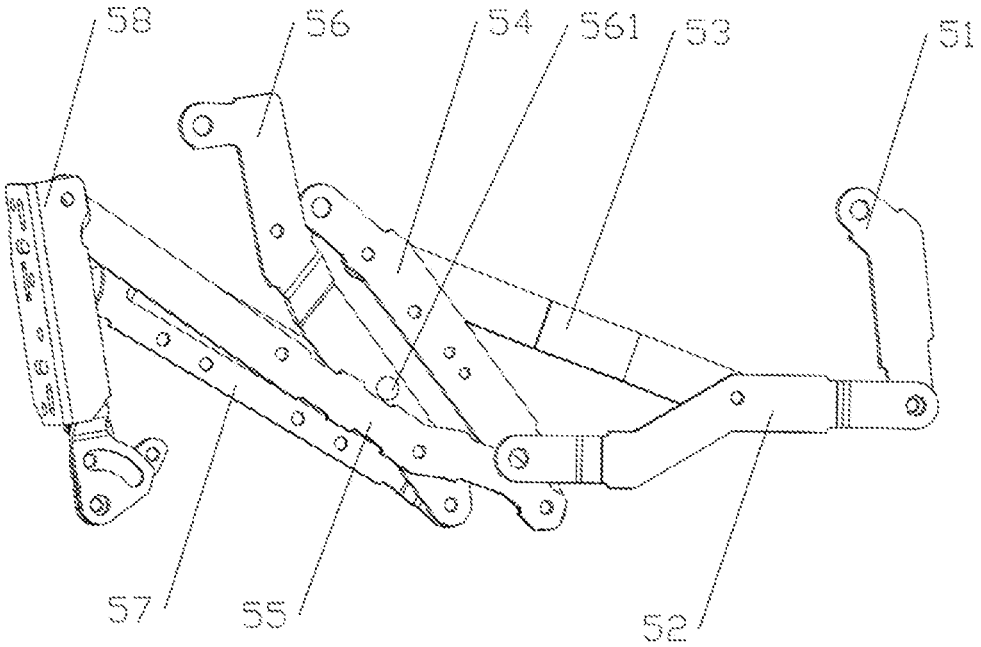
FIG. 5 is a structure view of a leg assembly of an elderly chair support according to an embodiment of the present disclosure.

As shown in FIGS. 3 to 5, optionally, the leg assembly 5 includes a first stretching member 51, a second stretching member 52, a third stretching member 53, a fourth stretching member 54, a fifth stretching member 55, a sixth stretching member 56, a seventh stretching member 57, and a support member 58, where the first stretching member 51 is pivoted to the support plate 41 at a first pivot point, the second stretching member 52 is pivoted to the first stretching member 51, the third stretching member 53 and the power rod 3 in sequence at a second pivot point, a third pivot point, and a fourth pivot point respectively, the third pivot point is located between the second pivot point and the fourth pivot point, the fourth stretching member 54 is pivoted to the third stretching member 53, the support plate 41 and the fifth stretching member 55 in sequence at a fifth pivot point, a sixth pivot point and a seventh pivot point respectively, the fifth pivot point is located between the sixth pivot point and the seventh pivot point, the fifth stretching member 55 is pivoted to the support member 58, the sixth stretching member 56 has an end pivoted to the support plate 41 at an eighth pivot point and the other end pivoted to the seventh stretching member 57, the seventh stretching member 57 is pivoted to the support member 58, the sixth pivot point is located between the first pivot point and the eighth pivot point, and the sixth stretching member 56 is provided with a guide block 561 capable of abutting against the fifth stretching member 55. When the power rod 3 rotates relative to the support plate 41, the power rod 3 drives the second stretching member 52 to move, the second stretching member 52 drives, through the third stretching member 53, the fourth stretching member 54 to move, the fourth stretching member 54 drives the fifth stretching member 55 to move, the guide block 561 on the sixth stretching member 56 abuts against the fifth stretching member 55, the fifth stretching member 55 can drive the sixth stretching member 56 to move, the sixth stretching member 56 drives the seventh stretching member 57 to move, and the fifth stretching member 55 and the seventh stretching member 57 together drive the support member 58 to move so that the leg assembly 5 stretches or retracts.

As shown in FIG. 1, optionally, a second drive assembly and an angle adjustment member 9 are further included, where the angle adjustment member 9 is hinged to a backrest connecting rod 10 hinged to the support plate 41, and the second drive assembly is capable of driving the angle adjustment member 9 to rotate relative to the support plate 41. The second drive assembly drives the angle adjustment member 9 to rotate relative to the support plate 41 so that the backrest angle of the elderly chair is adjusted.

Optionally, the second drive assembly includes a second electric push rod 81 and a second connecting rod 82, where an end of the second electric push rod 81 is hinged to a third connecting rod 20, the other end of the second electric push rod 81 is hinged to the second connecting rod 82, the second connecting rod 82 is fixedly connected to the support plate 41, and the third connecting rod 20 is fixedly connected to the angle adjustment member 9. The electric push rod has the characteristics of a small volume, high precision, and good self-locking performance.

Figure 2:
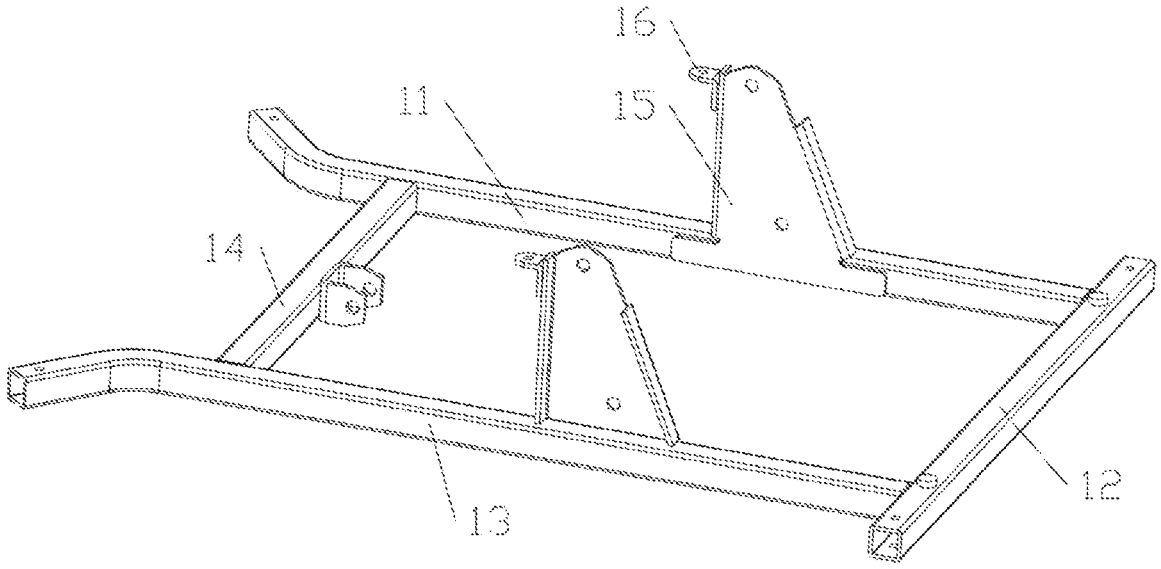
FIG. 2 is a structure view of a base of an elderly chair support according to an embodiment of the present disclosure.

As shown in FIG. 2, optionally, the base 1 includes a first support rod 11, a second support rod 12, a third support rod 13, and a fourth support rod 14, which are fixedly connected end to end in sequence to form a rectangle, where a support seat 15 is fixedly provided on each of the first support rod 11 and the third support rod 13, a bracket 16 is fixedly provided on the support seat 15, and the anti-torsion tube 42 is capable of abutting against the bracket 16.

Optionally, a cushion is provided on the bracket 16. The cushion can mitigate the collision between the anti-torsion tube 42 and the bracket 16.

Optionally, two support plates 41 and two leg assemblies 5 are provided, where the two support plates 41 are connected to and two leg assemblies 5 in one-to-one correspondence, and two ends of the anti-torsion tube 42 are fixedly connected to the two support plates 41 respectively so that the elderly chair support has higher stability.

An elderly chair includes the preceding elderly chair support.

What is claimed is:

1. An elderly chair support, comprising a base, a first drive assembly, a power rod, a support assembly, a leg assembly, a first lifting rod, and a second lifting rod, wherein the support assembly comprises a support plate and an anti-torsion tube fixedly connected to the support plate; two ends of the first lifting rod are pivoted to the support plate and the base respectively, and two ends of the second lifting rod are pivoted to the support plate and the base respectively; and wherein the first drive assembly is capable of driving the power rod to rotate relative to the support plate to have a first position and a second position, in a case where the power rod is at the first position, the leg assembly stretches and the anti-torsion tube abuts against the base, in a case where the power rod is at the second position, the leg assembly retracts and the anti-torsion tube has a first distance from the base, and in the case where the power rod is at the second position, the first drive assembly is capable of driving the power rod to drive the support plate to move synchronously so that the support plate has a second distance from the base.

2. The elderly chair support according to claim 1, wherein the first drive assembly comprises a first electric push rod and a first connecting rod, wherein the first electric push rod has an end hinged to the base and another end hinged to the first connecting rod, and the first connecting rod is connected to the power rod.

3. The elderly chair support according to claim 2, wherein the support plate is provided with a guide slot, and the power rod is provided with a guide post, wherein the guide post is configured to be slidably disposed in the guide slot and is connected to the first connecting rod.

4. The elderly chair support according to claim 1, wherein the leg assembly comprises a first stretching member, a second stretching member, a third stretching member, a fourth stretching member, a fifth stretching member, a sixth stretching member, a seventh stretching member, and a support member, wherein the first stretching member is pivoted to the support plate at a first pivot point, the second stretching member is pivoted to the first stretching member, the third stretching member and the power rod in sequence at a second pivot point, a third pivot point and a fourth pivot point respectively, the third pivot point is located between the second pivot point and the fourth pivot point, the fourth stretching member is pivoted to the third stretching member, the support plate and the fifth stretching member in sequence at a fifth pivot point, a sixth pivot point and a seventh pivot point respectively, the fifth pivot point is located between the sixth pivot point and the seventh pivot point, the fifth stretching member is pivoted to the support member, the sixth stretching member has an end pivoted to the support plate at an eighth pivot point and another end pivoted to the seventh stretching member, the seventh stretching member is pivoted to the support member, the sixth pivot point is located between the first pivot point and the eighth pivot point, and the sixth stretching member is provided with a guide block capable of abutting against the fifth stretching member.

5. The elderly chair support according to claim 1, further comprising a second drive assembly and an angle adjustment member, wherein the angle adjustment member is hinged to a backrest connecting rod connected to the support plate, and the second drive assembly is capable of driving the angle adjustment member to rotate relative to the support plate.

6. The elderly chair support according to claim 5, wherein the second drive assembly comprises a second electric push rod and a second connecting rod, wherein an end of the second electric push rod is hinged to a third connecting rod, another end of the second electric push rod is hinged to the second connecting rod, the second connecting rod is fixedly connected to the support plate, and the third connecting rod is fixedly connected to the angle adjustment member.

7. The elderly chair support according to claim 1, wherein the base comprises a first support rod, a second support rod, a third support rod and a fourth support rod, which are fixedly connected end to end in sequence to form a rectangle, wherein a support seat is fixedly provided on each of the first support rod and the third support rod, a bracket is fixedly provided on the support seat, and the anti-torsion tube is capable of abutting against the bracket.

8. The elderly chair support according to claim 7, wherein a cushion is provided on the bracket.

9. An elderly chair, comprising an elderly chair support:

wherein the elderly chair support comprises a base, a first drive assembly, a power rod, a support assembly, a leg assembly, a first lifting rod, and a second lifting rod, wherein the support assembly comprises a support plate and an anti-torsion tube fixedly connected to the support plate; two ends of the first lifting rod are pivoted to the support plate and the base respectively, and two ends of the second lifting rod are pivoted to the support plate and the base respectively; and wherein the first drive assembly is capable of driving the power rod to rotate relative to the support plate to have a first position and a second position, in a case where the power rod is at the first position, the leg assembly stretches and the anti-torsion tube abuts against the base, in a case where the power rod is at the second position, the leg assembly retracts and the anti-torsion tube has a first distance from the base, and in the case where the power rod is at the second position, the first drive assembly is capable of driving the power rod to drive the support plate to move synchronously so that the support plate has a second distance from the base.

10. The elderly chair according to claim 9, wherein the leg assembly comprises a first stretching member, a second stretching member, a third stretching member, a fourth stretching member, a fifth stretching member, a sixth stretching member, a seventh stretching member, and a support member, wherein the first stretching member is pivoted to the support plate at a first pivot point, the second stretching member is pivoted to the first stretching member, the third stretching member and the power rod in sequence at a second pivot point, a third pivot point and a fourth pivot point respectively, the third pivot point is located between the second pivot point and the fourth pivot point, the fourth stretching member is pivoted to the third stretching member, the support plate and the fifth stretching member in sequence at a fifth pivot point, a sixth pivot point and a seventh pivot point respectively, the fifth pivot point is located between the sixth pivot point and the seventh pivot point, the fifth stretching member is pivoted to the support member, the sixth stretching member has an end pivoted to the support plate at an eighth pivot point and another end pivoted to the seventh stretching member, the seventh stretching member is pivoted to the support member, the sixth pivot point is located between the first pivot point and the eighth pivot point, and the sixth stretching member is provided with a guide block capable of abutting against the fifth stretching member.

11. The elderly chair according to claim 9, wherein the first drive assembly comprises a first electric push rod and a first connecting rod, wherein the first electric push rod has an end hinged to the base and another end hinged to the first connecting rod, and the first connecting rod is connected to the power rod.

12. The elderly chair according to claim 11, wherein the support plate is provided with a guide slot, and the power rod is provided with a guide post, wherein the guide post is configured to be slidably disposed in the guide slot and is connected to the first connecting rod.

13. The elderly chair according to claim 9, wherein the elderly chair support further comprises a second drive assembly and an angle adjustment member, wherein the angle adjustment member is hinged to a backrest connecting rod connected to the support plate, and the second drive assembly is capable of driving the angle adjustment member to rotate relative to the support plate.

14. The elderly chair according to claim 13, wherein the second drive assembly comprises a second electric push rod and a second connecting rod, wherein an end of the second electric push rod is hinged to a third connecting rod, another end of the second electric push rod is hinged to the second connecting rod, the second connecting rod is fixedly connected to the support plate, and the third connecting rod is fixedly connected to the angle adjustment member.

15. The elderly chair according to claim 9, wherein the base comprises a first support rod, a second support rod, a third support rod and a fourth support rod, which are fixedly connected end to end in sequence to form a rectangle, wherein a support seat is fixedly provided on each of the first support rod and the third support rod, a bracket is fixedly provided on the support seat, and the anti-torsion tube is capable of abutting against the bracket.

16. The elderly chair according to claim 15, wherein a cushion is provided on the bracket.

* * * * *